United States Patent [19]

Rüppel

[11] Patent Number: 4,723,588

[45] Date of Patent: Feb. 9, 1988

[54] ROLLER SHUTTER SLAT OF THE SO-CALLED MINI-SIZE MADE FROM A ROLL-SHAPED ALUMINIUM STRIP

[76] Inventor: Kurt Rüppel, Dillberg 22, D-8772 Marktheidenfeld, Fed. Rep. of Germany

[21] Appl. No.: 751,533

[22] Filed: Jul. 3, 1985

[30] Foreign Application Priority Data

Jul. 5, 1984 [DE] Fed. Rep. of Germany ... 8420098[U]

[51] Int. Cl.[4] ..... E06B 9/16

[52] U.S. Cl. ..... 160/236; 160/235

[58] Field of Search ..... 160/236, 235, 232

[56] References Cited

U.S. PATENT DOCUMENTS

| | | | |
|---|---|---|---|
| 4,416,047 | 11/1983 | Riexinger et al. | 160/235 X |
| 4,436,136 | 3/1984 | Downey | 160/236 X |
| 4,470,444 | 9/1984 | Riexinger et al. | 160/235 |

FOREIGN PATENT DOCUMENTS

| | | | |
|---|---|---|---|
| 3113656 | 10/1982 | Fed. Rep. of Germany | 160/236 |
| 3115729 | 11/1982 | Fed. Rep. of Germany | 160/236 |
| 2313542 | 12/1976 | France | 160/236 |
| 6408875 | 2/1966 | Netherlands | 160/235 |

*Primary Examiner*—Ramon S. Britts
*Assistant Examiner*—David M. Purol
*Attorney, Agent, or Firm*—Larson & Taylor

[57] ABSTRACT

A roller shutter slat comprises a hollow chamber profile of the so-called mini-size cut from a plastic-foamed aluminium strip to the width of the roller shutter. The said hollow chamber profile includes two unidirectionally curved main sections being of an outer-sided convex and outer-sided concave configuration, respectively, which, at the one end thereof, are bent with respect to one another first inwardly and then, in abutting relationship, outwardly by subsequently forming a double-walled hook, and at the other ends thereof are interconnected by forming a pocket open toward the profiled end and semi-circularly rounded at the bottom for receiving the hook of the next roller shutter bar. According to the invention, particular dimensions are provided for the thickness of the aluminium strip and the characteristic measures of the profile to allow substantially lower cost of production and reduced winding diameter with no substantial loss in strength and rigidity.

4 Claims, 9 Drawing Figures

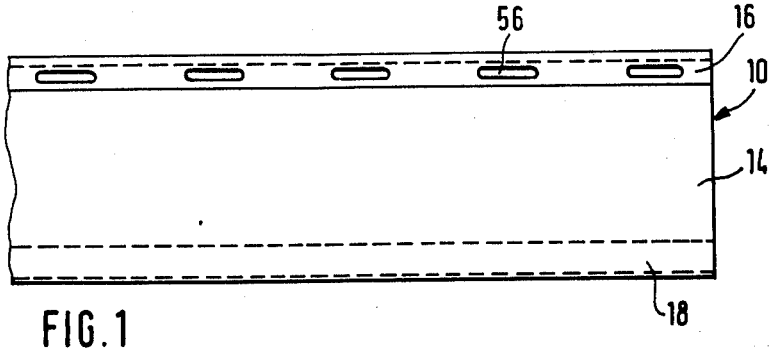
FIG.1
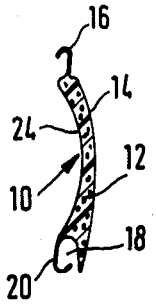
FIG.2
FIG.6
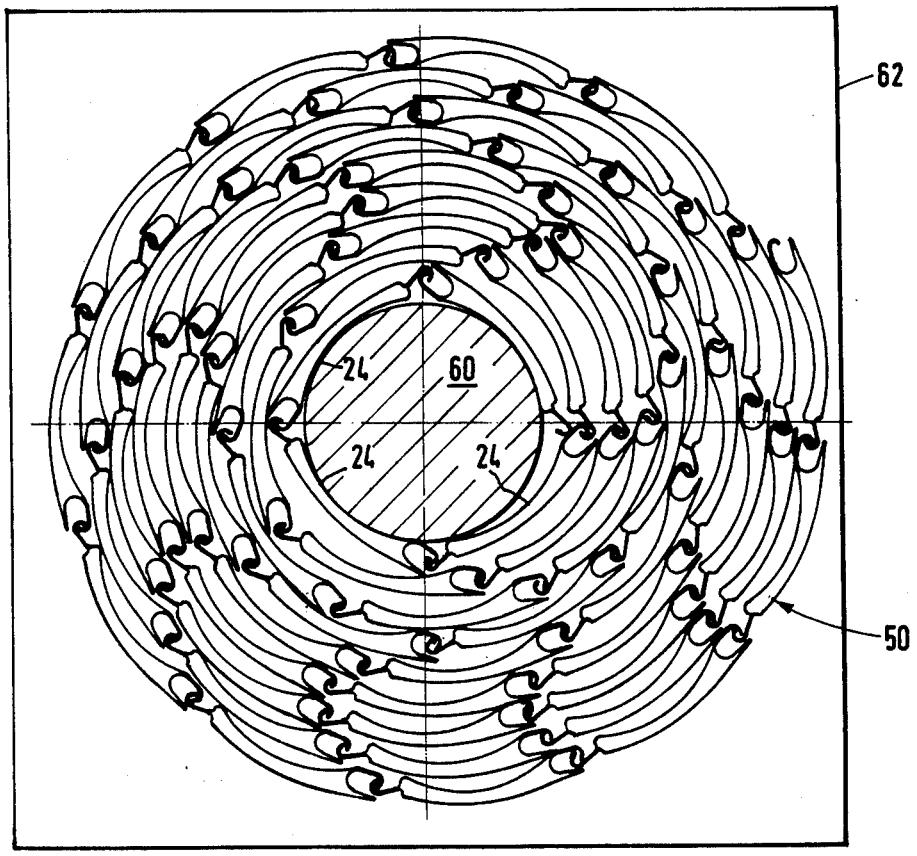

ROLLER SHUTTER SLAT OF THE SO-CALLED MINI-SIZE MADE FROM A ROLL-SHAPED ALUMINIUM STRIP

FIELD OF THE INVENTION

This invention relates to a roller shutter assembly and more particularly to a roller shutter slat comprising a hollow chamber profile of the so-called mini-size cut from a plastic-foamed aluminium strip to the width of the roller shutter, with the said hollow chamber profile including two main sections unindirectionally curved thereby being of an outer-sided convex and of an outer-sided concave configuration,respectively, which sections, at the one ends thereof first are bent inwardly with respect to one another and then, in abutting relationship, are bent outwardly with respect to one another, forming a double-walled hook at the end of which bent toward the external concave longitudinal section the band edges embrace one another, and at the other endes thereof, are interconnected by forming a pocket open toward the profiled end and semi-circularly rounded at the bottom for receiving the hook of the next slat of the roller shutter, with the side walls of the pocket extending substantially in parallel to one another being formed by a sharp-edged backward bending of the profiled main sections and the backward bending being located at the outer-sided concave profiled main section at the end of a double-walled counter-hook bent into the pocket for the hook of the next slat of the roller shutter.

BACKGROUND OF THE INVENTION

While this typical configuration of the hollow chamber profile is applicable to all profile sizes employed, in practice, three different size groups have developed which can be classified by their covering width, i.e. by the effective slat width, determining the slat division in the closed shutter, as follows:

- maxi-profiles having a covering width of about 52–55 mm
- standard profiles having a covering width of about 42 mm
- mini-profiles having a covering width of about 32–33 mm.

The wider the covering width the larger the required dimension of the winding shaft diameter and the larger the outer diameter of the wound roller shutter. In housing conctruction, especially in the subsequent assembly and dissembly of roller shutters within the old buildings modernizing and reconstructing program, it is the mini-profile that is exclusively employed as it permits the use of winding shafts having diameters of as little as 40 mm.

The material to be considered for the roller shutter slat is extruded plastic material or roll-shaped curable plastic-formed aluminium strip material. The use of extruded plastic, admittedly, is comparatively low-priced permitting far-reaching liberties as to profile shaping; also, plastic roller-type shutters are less noisy in windy weather. However, the disadvantages exhibited by plastic material are the low degree of rigidity and an inadequate safety against burglary. Compared therewith, roller shutter slats of aluminium are substantially more expensive. However, by foaming them with, for example, polyurethane, they attain substantial rigidity. Hence, they cannot be readily forced open without applying substantial efforts and involving unreasonable noise.

The higher costs involved with aluminium slats, mainly, are due to the high material cost of the employed aluminium slats. With band thickness of 0.36–0.38 mm as commonly employed with the mini-profile, they exceed the costs of corresponding plastic, slats by 50 percent or more. Reduced slat, thicknesses would, therefore, be desirable for cost-saving reasons. However, in the profile dimensions developed for the mini-profile, this would involve an unsatisfactory decrease in rigidity both in the central hollow chamber area and on the hook and counter-hook.

Moreover, conventional hollow chamber profiles exhibit substantial difficulties in the event of extended shutter lengths of two meters or more as with doors. The resultant winding diameters require substantial cross-sections of the roller shutter casings which are deemed unsatisfactory especially with pre-assembled roller shutters.

It is the object of the invention to overcome the aforementioned disadvantages and provide a roller shutter slat of the above mentioned type which is made from roll-shaped aluminium strip and which, with a constant covering width within the above tolerance for the so-called mini-profile, can be manufactured at substantially lower cost, at the same time permitting a substantially reduced winding diameter in extended shutter length with no substantial loss in strength and rigidity as compared with the known roller shutter slats.

SUMMARY OF THE INVENTION

In accordance with the invention, this problem can be solved by the following profile dimensions under consideration of the indicated tolerances:

(a) the thickness of the material of the aluminum strips is 0.28 mm, with a tolerance of +0.02 mm or −0.05 mm, (b) the straight line chord length of the width of the outwardly convex main wall from its junction with the pocket located at one end to the location where the outwardly convex wall bends inwardly is 31.5 mm, with a tolerance of +0.05 mm or −0.05 mm (c) the radius of curvature of the outwardly convex main wall is 38.0 mm, with a tolerance of +4 mm, (d) the radius of curvature of the outwardly concave main wall is 21.0 mm, with a tolerance of +3 mm, (e) the distance between the outwardly convex and outwardly concave main walls at their closest points is 2.3 mm, with a tolerance of +0.5 mm, (f) the hook at one end of the profile has a length of 5.2 mm, with a tolerance of −0.3 mm, and the thickness of the hook, taken along a line from its staight shaft to its hook end is 2.5 mm, with a tolerance of −0.3 mm, and the straight shaft of this hook extending at an angle relative to a plane throught the shutter guide surfaces of 8°, with a tolerance of +3° or −2°, when the hook is pushed as far as possible into the pocket of an adjacent slat, (g) the pocket has an interior thickness, between adjacent side walls, of 3.3 mm, with a tolerance of −0.3 mm, and the pocket has a width from its semi-circular bottom to the sharp edge which it forms with the outwardly convex side wall of 5.35 mm, with a tolerance of −0.3 mm, and the straight side of the pocket which extends to form a counter-hook extending at an angle of 8°, with a tolerance of −5°, relative to a reference plane formed by the guide shutter surfaces, and (h) the profile is shaped such that it fits between guide surfaces of a guide shutter spaced apart by 7.5 mm, with a tolerence of +0.2 mm or −0.5 mm.

The profile dimensions according to the invention, due to the different radii of curvature of the profile main sections and the small distance between the outer sides thereof at the most constricted point, result in a generally very flat profile with a low width of the hollow chamber enclosed therebetween, which on account of the substantilly reduced radius of curvature at the outer-sided concave profile section nevertheless provides a high bending strength and torsion-resistant rigidity. The resultant low width of the pocket receiving the hook of the adjacent roller shutter slat permits, in conjunction with the reduced band strength, a dainty and at the same time a shorter-length configuration of the profile hook thereby also permitting a shorter length of the pocket and a more delicate configuration of the counter-hook without affecting the rigidity of the hook connection and the length of displacement of the hook in the pocket. This will also permit, with the roller shutter slat according to the invention, to provide and efficiently use light slots in the shaft area of the profile hook, that have a width of 1.5 mm.

Due to the heavy curvature of the outer-sided concave profile main section, already in the first layer on the winding shaft, a favorable conformity to the curvature thereof is attained, with the following layers equally closely conforming to one another so that with a shaft diameter of 40 mm, the maximum outer diamter of the wound shutter, with between 69 and 73 roller shutter slats as may be employed for door openings, will not exceed 140 mm.

According to a first feature of an advantageous embodiment of the invention, the transverse displacement of the profile hook over the outer-sided concave profile main section at the end thereof first bent inwardly and then bent outwardly amounts to 2–0.3 mm.

According to another feature of the invention, the outer-sided concave profile main section ends at the beginning of the pocket at which point, by forming a bend, the double-walled counter-hook follows, the straight-lined shaft of which substantially has the same direction of inclination as the shaft of the profiled hook disposed on he other profile end. Advantageously, the space between the outer sides of the profiled main sections, on the counter-hook-sided end of the outer-sided concave profiled main section, is about 5 mm.

BRIEF DESCRIPTION OF THE DRAWING

The invention will now be described in closer detail with reference to the drawing, therein FIG. 1 is an outer-sided view of the one end of a roller shutter slat of any desired length as provided by the invention, made from a section of roll-shaped, plastic-foamed aluminium strip;

FIG. 2 is a front view of FIG. 1;

FIG. 6 is the front view of a shutter comprising 69 slats and wound up on a winding shaft of a 40 mm diameter inside a roller shutter casing being of an internal width of 140 mm, and FIGS. *7a, b* and *c* are about 10-fold enclarged views of the hook engagement between two roller shutter slats in the innermost, a central and the outermost position of the wound shutter to illustrate the radial space requirements of the said positions.

DESCRIPTION OF THE PREFERRED EMBODIMENT

Figure 3:
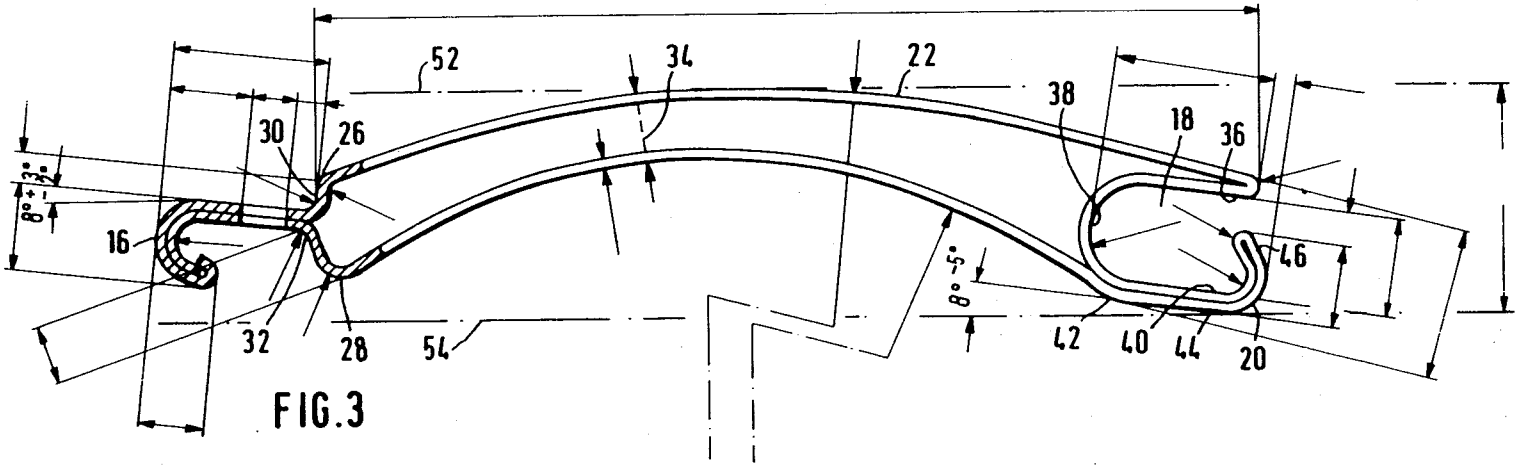
FIG. 3 is a five-fold enlargement of the hollow chamber profile corresponding to the front view of FIG. 2, indicating the profile dimensions and permitted tolerances thereof typical of the invention.

In FIGS. 1 and 2 of the drawing, the one end of a roller shutter slat of the so-called mini-size is designated by numeral 10, with the slat being cut from a roll-formed aluminium strip foamed by a curable plastic material such as polyurethane. The aluminium strip, in its original state, has a width of 100 mm and a thickness of $$0.28\ ^{+0.02}_{-0.05}\ \text{mm}$$

and may be coated by a varnish layer of about 0.04 mm.

A hollow chamber profile, the basic form of which has already been employed for conventional roller shutter slats, is formed from an aluminium strip by roll-shaping between a variety of series-arranged roller pairs. The hollow chamber profile is substantially composed of three parts, viz. a central hollow chamber 14 receiving the foam plastic 12, a double-walled hook 16 mounted on the one end of the said chamber 14, and a pocket 18 provided with a counter-hook 20.

The marginal areas of the aluminium strip meet at the head of the double-walled hook 16 at the outer end of which one of the marginal areas embraces the outer as shown in FIG. 3.

The central hollow chamber 16 is enclosed between the outer-sided convex profiled main section 22 and an outer-sided concave profiled main section 24 which, at the hook-sided end, at 26 and 28, respectively, are bent inwardly one against the other and then, in abutting relationship, to form the hook 16 at 30 and 32, respectively, are again bent outwardly. The radius of curvature of the outer-sided convex profiled main section 22, at the outer side thereof, is 38.0+4 mm, and the radius of curvature of the outer-sided concave profiled main section 24, at the outer side thereof, has a dimension of 21.0+3 mm, with the space between the outer sides of the profiled main sections 22, 24 at the most constricted point 34, being 2.3+0.5 mm.

The outer-sided convex profiled main section 22 extends along a chord length of 31.5±0.5 mm corresponding to the division of the roller shutter, to the open end of the pocket 18 disposed opposite hook 16, with the wall parts 36, 38, 40 of the said pocket interconnecting the two profiled main sections 22, 24 by the counter-hook 20. The two wall parts 36 and 40 extend substantially straight-forward and in parallel to one another at an inner distance of 3.0−0.3 mm determining the width of the pocket 18, and are interconnected by the interposed semi-circular wall portion 38, with the distance between the outer end of the pocket 18 at the outer-sided convex profiled main section 22 and the bottom of the pocket 18 on the semicircular wall portion 38 being 5.35−0.3 mm.

The outer-sided concave profiled main section 24 terminates at 42 at the junction between wall portion 38 and wall portion 40 of pocket 18; the profile continues to extend from there, forming a bend in abutting relationship with pocket portion 40, to form a straight-lined shaft 44 of counter-hook 20, the outer end 46 of which is bent back inwardly into pocket 18 to form the hook head. A maximum space will thereby be formed between the outer sides of the two profiled main sections 22, 24 at the aforementioned bend in the order of about 5.0−0.3 mm.

Further typical dimensions of the hollow chamber profile according to the invention and the embodiment thereof are shown in FIG. 3.

Figure 4:
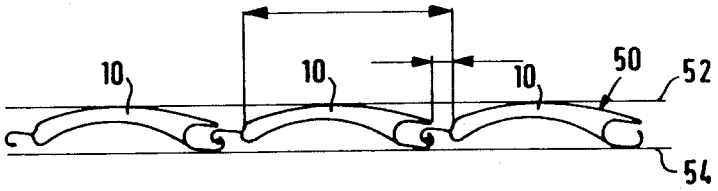
FIG. 4 is the front view of a roller shutter shown in the form of three engaging slats according to FIG. 3 in extended and drawn-apart condition when let down or drawn up, within lateral guide rails.
Figure 5:
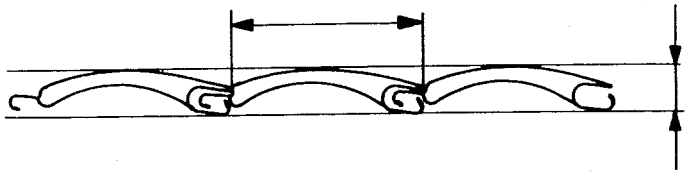
FIG. 5 is the same front view as the one shown in FIG. 4, except in contracted condition with the shutter completely let down.
Figure 7A:
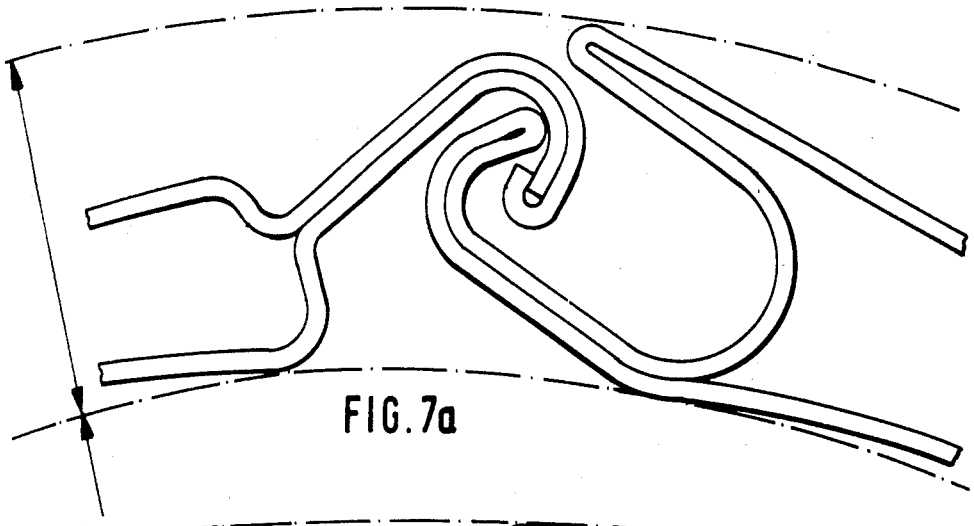
Figure 7B:
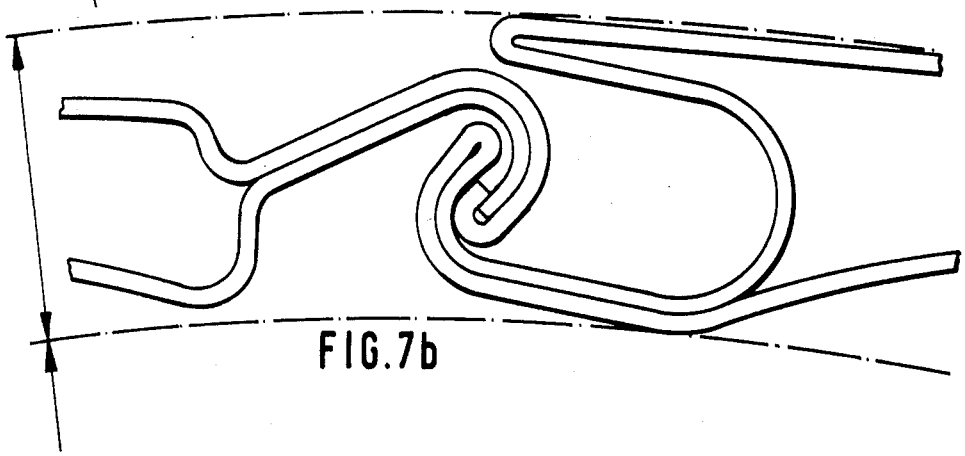
Figure 7C:
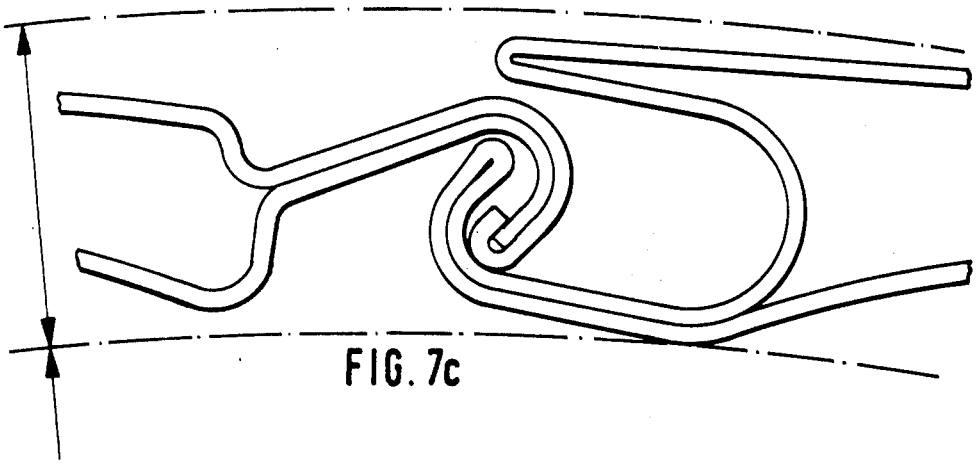

FIGS. 4 and 5 of the drawing show a roller shutter 50, comprising respectively three engaging roller shutter slats 10, the ends thereof being guided in guiding rails of an inner width of $$7.5\,^{+0.2}_{-0.5}\ \text{mm}$$

disposed on either side thereof and indicated by lines 52 and 54. FIG. 4 shows the shutter in drawn-apart condition as present during let-down or drawn-up movement, while FIG. 5 shows same in contracted condition occurring by the bottommost slat abutting on the window or door reveal or on any other stop means.

While, in the contracted condition according to FIG. 5, the chord length of the outer-sided convex profiled main section 22 determines the spacing of the shutter slats by 31.5±0.5 mm, the said spacing, during drawing-apart as shown in FIG. 4, increases by 3±0.2 mm to 34.5±0.7 mm by releasing a corresponding shaft length of the profile hook 16 in which, as shown in FIG. 1, the standard ventilation slots 56 can be provided with a width of preferably 3 mm.

The substantially oriented shafts of hooks 16 and the counter-hook 20 cooperating with the former, in the shutter 50, are backwardly bent over the guide rails 52, 54 at an angle of $$8^\circ\,^{+3^\circ}_{-2^\circ}$$

and 8.5°−5°, respectively, (FIG. 3).

FIG. 6 shows a shutter 50 formed of 69 roller-type shutter slats of this type and spooled on a winding shaft 60 of a 40 mm diameter within a roller shutter casing indicated at 62. As shown, the first three roller shutter slats, on account of the substantial curvature of their outer-sided concave profiled sections 22, closely conform to the curvature of the winding shaft 60, displacing, as shown in FIG. 6 in conjunction with FIG. *7a*, the superposed next layer of roller shutter slats to an inner radius larger by 6.0 mm. This increase in radius first decreases from layer to layer to a radius of about 48 mm to about 5.1 mm (FIG. *7b*) and then increases again to a radius of 64 mm to about 5.5 mm. The final layer of roller shutter slats, virtually, will reach, as shown by FIG. *7c*, an outer radius of 69.5 mm on which 69 to 73 roller shutter slats can be arranged.

With a spacing of 31.5 mm length of the folded shutter comprising 73 slats, is about 230 mm wich will even be adequate for doors of great height comprising tiltable ventilation windows disposed thereabove. This will be attained by a roller shutter casing smaller by 20 mm in height and width over conventional profile dimensions. This will not only meet the desired measurements of assembly but, above all, will be considerably more attractive in outward appearance.

What is claimed is:

1. A roller shutter slat comprising:

a hollow chamber profile cut to a desired length from a longer length of foam filled aluminum strip, the hollow profile, viewed in transverse cross-section, comprising first and second main walls, both curved in the same direction, such that the outwardly facing surface of the first main wall is convex and the outwardly facing surface of the second main well in concave, the walls at one end of the profile cross-section being bent inwardly, toward each other to form a double walled hook having a straight shaft curving to a hook end, said curvature which extends toward the hook end being toward the concave main wall, the walls at the other end of the profile cross-section forming a pocket, open along that end of the profile, the pocket having a semi-circuit shaped bottom facing toward the opening and adapted to receive a hook, similar to the said hook, but of another cooresponding shaped slat, the side walls of the pocket adjacent the semi-circular shaped bottom being generally straight and generally parallel to each other, the side of the pocket adjacent the outwardly convex main wall formed by a sharp angle of the end of the outwardly convex main wall, the side of the pocket adjacent the concave main wall forming, with an extension of the outwardly concave main wall, a double-walled counter hook extending toward the convex main wall and adapted to hookingly mate with the said hook at the said one end, but of another, correspondingly shaped slat, the said profile having points along its surface which are adapted to engage guide surfaces of a guide shutter, wherein:

(a) the thickness of the material of the aluminum strips is 0.28 mm, +0.02 mm or −0.05 mm.

(b) the straight line chord length of the width of the convex main wall from its junction with the pocket to the location where it bends inwardly at the said one end is 31.5 mm, +0.05 mm or −0.05 mm, (c) the radius of curvature of the outwardly convex main wall is 38.0 mm, +4 mm, (d) the radius of curvature of the outwardly concave main wall is 21.0 mm, +3 mm, (e) the distance between the first and second walls at their closest point is 2.3 mm, +0.5 mm, (f) the hook, at said one end has a length of 5.2 mm, −0.3 mm, and the thickness of the hook, taken along a line from its straight shaft to its hook end is 2.9 mm, −0.3 mm, and the straight shaft of the hook extends at an angle relative to a plane through the shutter guide surfaces, of 8°, +3° or −2°, when the hook is pushed as far as possible into the pocket of an adjacent slat, (g) the pocket has an interior thickness between adjacent side walls of 3.3 mm, −0.3 mm, and said pocket has a width from the semi-circular bottom to the said sharp angle with the outwardly convex side wall which is 5.35 mm, −0.3 mm, and the straight side of the pocket adjacent the counter hook extends at an angle of 8°, −5°, relative to the reference plane when the hook is pushed as far as possible into the pocket of an adjacent slat, (h) and the profile is shaped such that it fits between guide surfaces of a guide shutter spaced apart by 7.5 mm, +0.2 mm or −0.5 mm.

2. A roller shutter slat according to claim 1, wherein the portion of the second main wall bent inwardly from its outwardly concave portion to the point where in joins the straight shaft of the hook at the said one end is 2 mm, −0.3 mm.

3. A roller shutter slat according to claim 1, wherein the outwardly concave main wall bends adjacent the location where the semi-circular bottom of the pocket joins the closest said straight side wall thereof and extends toward said counter hook adjacent and parallel to said side wall.

4. A roller shutter slat according to claim 3, wherein the distance between the outer surfaces of the main walls at the end of the profile adjacent the counter hook is 5.0 mm, −0.3 mm.

* * * * *